US007058353B2

(12) United States Patent
Lee et al.

(10) Patent No.: US 7,058,353 B2
(45) Date of Patent: Jun. 6, 2006

(54) PAPER DETECTING DEVICE OF PAPER FEEDING CASSETTE AND AN IMAGE FORMING APPARATUS HAVING THE SAME

(75) Inventors: Young-sil Lee, Seoul (KR); Kwang-ho No, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/901,037

(22) Filed: Jul. 29, 2004

(65) Prior Publication Data

US 2005/0141902 A1 Jun. 30, 2005

(30) Foreign Application Priority Data

Dec. 27, 2003 (KR) ..... 10-2003-0098035

(51) Int. Cl.
*G03G 15/00* (2006.01)

(52) U.S. Cl. ..... 399/393; 400/624; 271/9.05; 271/153; 271/258.04

(58) Field of Classification Search ..... 400/624–629; 271/9.05, 153, 258.04; 399/393
See application file for complete search history.

(56) References Cited

U.S. PATENT DOCUMENTS 5,574,551 A * 11/1996 Kazakoff ..... 399/45
5,897,112 A * 4/1999 Kwag ..... 271/38
6,183,406 B1 * 2/2001 Barrus et al. ..... 493/320
6,308,947 B1 * 10/2001 Kojima et al. ..... 271/124
6,361,038 B1 3/2002 Tada et al.
6,636,704 B1 * 10/2003 Weaver et al. ..... 399/23
6,718,145 B1 * 4/2004 Ohta et al. ..... 399/16
6,804,474 B1 * 10/2004 Morita et al. ..... 399/23

FOREIGN PATENT DOCUMENTS

| | | |
|---|---|---|
| JP | 60-026546 | 2/1985 |
| JP | 60111908 A * | 6/1985 |
| JP | 07-225533 | 8/1995 |
| JP | 09-067022 | 3/1997 |
| JP | 11-130297 | 5/1999 |
| JP | 2000-034039 | 2/2000 |
| JP | 2000-234911 | 8/2000 |

* cited by examiner

*Primary Examiner*—Andrew H. Hirshfeld
*Assistant Examiner*—Dave A. Ghatt
(74) *Attorney, Agent, or Firm*—Roylance, Abrams, Berdo & Goodman, L.L.P.

(57) ABSTRACT

A paper detecting device to detect paper presence on a paper plate in a paper feeding cassette, and comprising a light-emitting device and a light-receiving sensor. In the paper feeding cassette, an end-fence is movably mounted, and at least one of the light-emitting device and the light-receiving sensor is mounted on a base of the end-fence to be covered by the stacked paper. Accordingly, before developing a new image, the complete consumption of the paper supply can be detected, and therefore, the toner can be saved.

20 Claims, 8 Drawing Sheets

PAPER DETECTING DEVICE OF PAPER FEEDING CASSETTE AND AN IMAGE FORMING APPARATUS HAVING THE SAME

CROSS-REFERENCE TO RELATED APPLICATIONS

This application claims the benefit under 35 U.S.C. §119 (a) of Korean Patent Application No. 2003-98035 entitled "Paper Detecting Device Of Paper Feeding Cassette And An Image Forming Apparatus Having The Same", filed in the Korean Intellectual Property Office on Dec. 27, 2003, the entire contents of which are incorporated herein by reference.

BACKGROUND OF THE INVENTION

1. Field of the Invention

The present invention relates to an image forming apparatus. More particularly, the present invention relates to a paper detecting device of a paper feeding cassette that is capable of detecting the presence of papers in the paper feeding cassette, and an image forming apparatus having the same.

2. Description of the Related Art

Conventional image forming devices include devices such as laser printers, light-emitting diode (LED) printers, inkjet printers, photocopiers, facsimiles, and multi-function office machines. In each case, the image forming apparatus is provided with a paper feeding device which supplies sheets of paper.

FIG. 1 shows a conventional image forming apparatus. As an example, a color laser printer is illustrated which scans a laser beam onto a plurality of photoconductive drums to form an electrostatic latent image thereon, and attaches a color toner onto the electrostatic latent image on the drums for printing out onto the paper.

As a printing job begins, a laser beam is projected from a laser scanning unit 120, thereby forming the electrostatic latent image on the photoconductive drums 121, 122, 123 and 124. A plurality of developing apparatus 131, 132, 133 and 134 then attach the toner onto the photoconductive drums 121, 122, 123 and 124, thereby forming toner images. A plurality of the toner images formed as described above are then superimposed on a transfer belt 141, and a final image on the transfer belt 141 is transferred to a paper P by a transfer roller 142. The paper P is continuously supplied from a paper feeding cassette 160 by a pickup roller 150.

If the paper P in the paper feeding cassette 160 is exhausted as shown in FIG. 2, an actuator 171 of a paper detecting device 170 rotates about an axis and is inserted into a slit 161*a* formed in a paper plate 161. At this time, a blocking part 171*a* of the actuator 170 is displaced from between a light-emitting device (not shown) and a light-receiving unit (not shown), indicating that the paper P supply is exhausted.

However, in the conventional image forming apparatus 100 as described above and as shown in FIG. 2, a first distance $L_1$ is substantially longer than a second distance $L_2$. That is, the first distance $L_1$ is defined from a developing position D where the toner is attached on the first photoconductive drum 121, to a transferring position T where the final image is transferred, and the second distance $L_2$ is defined from a sensing position S where the actuator 171 is inserted into the slit 161*a*, to the transferring position T. Therefore the conventional paper detecting device 170 having the above structure detects the exhaustion of the paper P in the paper feeding cassette 160 after a first developing is performed on the first photoconductive drum 121. This results in a waste of the toner and an overall inefficient process, since the toner attached on the photoconductive drum 121 needs to be removed to form a new image, and requires a waste toner collector.

Accordingly a need exists for a system and method to detect the exhaustion of the paper P in the paper feeding cassette 160 as quickly as possible, and more specifically, prior to a first developing being performed on the first photoconductive drum to minimize waste of toner.

SUMMARY OF THE INVENTION

An object of the present invention therefore, is to solve the above and other problems and/or disadvantages, and to provide at least the advantages described below. Accordingly, an object of the present invention is to provide a paper detecting device of a paper feeding cassette which is capable of detecting the exhaustion of paper in the paper feeding cassette within a time frame to avoid wasted developing steps, and an image forming apparatus having the same.

In order to achieve the above-described objects of the present invention, a paper detecting device is provided for detecting the presence of paper on a paper plate in the paper feeding cassette and which comprises a light-emitting device and a light-receiving sensor. An end-fence is movably mounted in the paper feeding cassette, and at least one of the light-emitting device and the light-receiving sensor are mounted on a base of the end-fence such that they are covered by the paper stack on the paper plate.

According to another embodiment of the present invention, a plurality of the light-emitting devices are provided in the paper plate, and can be distanced apart from each other along a path of the end-fence depending upon paper sizes being used.

According to another embodiment of the present invention, a plurality of the light-receiving sensors can be provided above the paper plate, and can also be distanced from each other along a path of the end-fence depending upon paper sizes being used.

According to still another embodiment of the present invention, both the light-emitting device and the light-receiving sensor can be mounted on the base of the end-fence.

In order to achieve the above-described objects of the present invention, an image forming apparatus is provided comprising a main body, a laser scanning unit, a photoconductive medium, a developing unit, a transfer unit, a paper feeding cassette, an end-fence, a pickup roller, a paper detecting device, and a control device. The paper detecting device comprises a light-emitting device and a light-receiving sensor, and wherein at least one of the light-emitting device and the light-receiving sensor is mounted on the base of the end-fence to be covered by the paper stacked on the paper plate.

The image forming apparatus according to another embodiment of the present invention further comprises a power supplying terminal mounted in the main body, an intermediate terminal mounted in the paper feeding cassette, and a connection terminal mounted in the end-fence.

The power supplying terminal, intermediate terminal and the connection terminal can further be electrically interconnected by a cable.

BRIEF DESCRIPTION OF THE DRAWINGS

The above objects and other features of the present invention will become more apparent from the following detailed description taken in conjunction with the accompanying drawings, in which.

Throughout the drawings, like reference numbers are used to refer to like features and structures.

DETAILED DESCRIPTION OF THE EXEMPLARY EMBODIMENTS

Hereinafter, a paper detecting device of a paper feeding cassette, and an image forming apparatus having the same according to embodiments of the present invention, will be described in detail with reference to the accompanying drawing figures.

Figure 1:
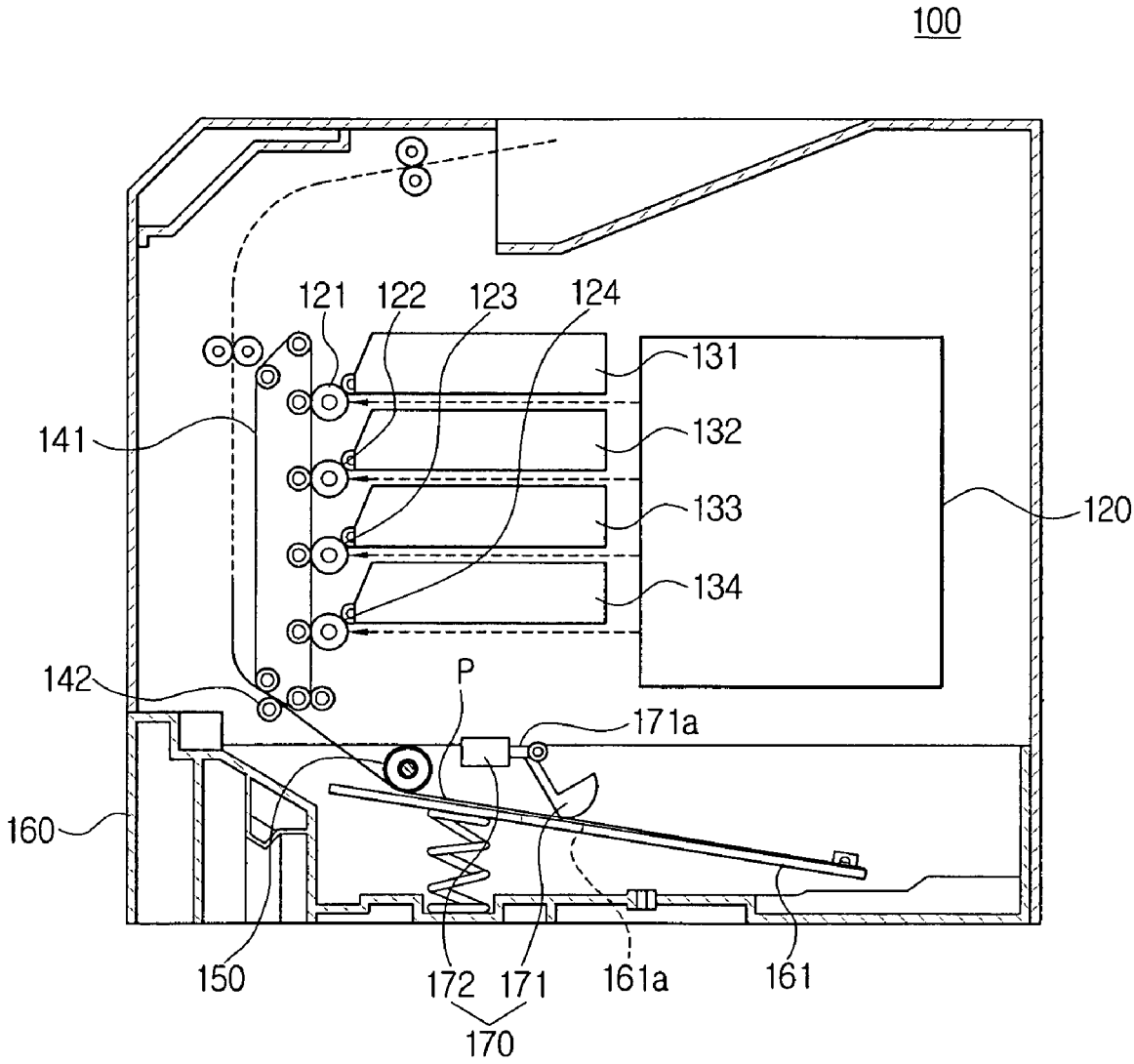
FIG. 1 (PRIOR ART)
FIG. 1 is a schematic view of an example conventional image forming apparatus.
Figure 2:
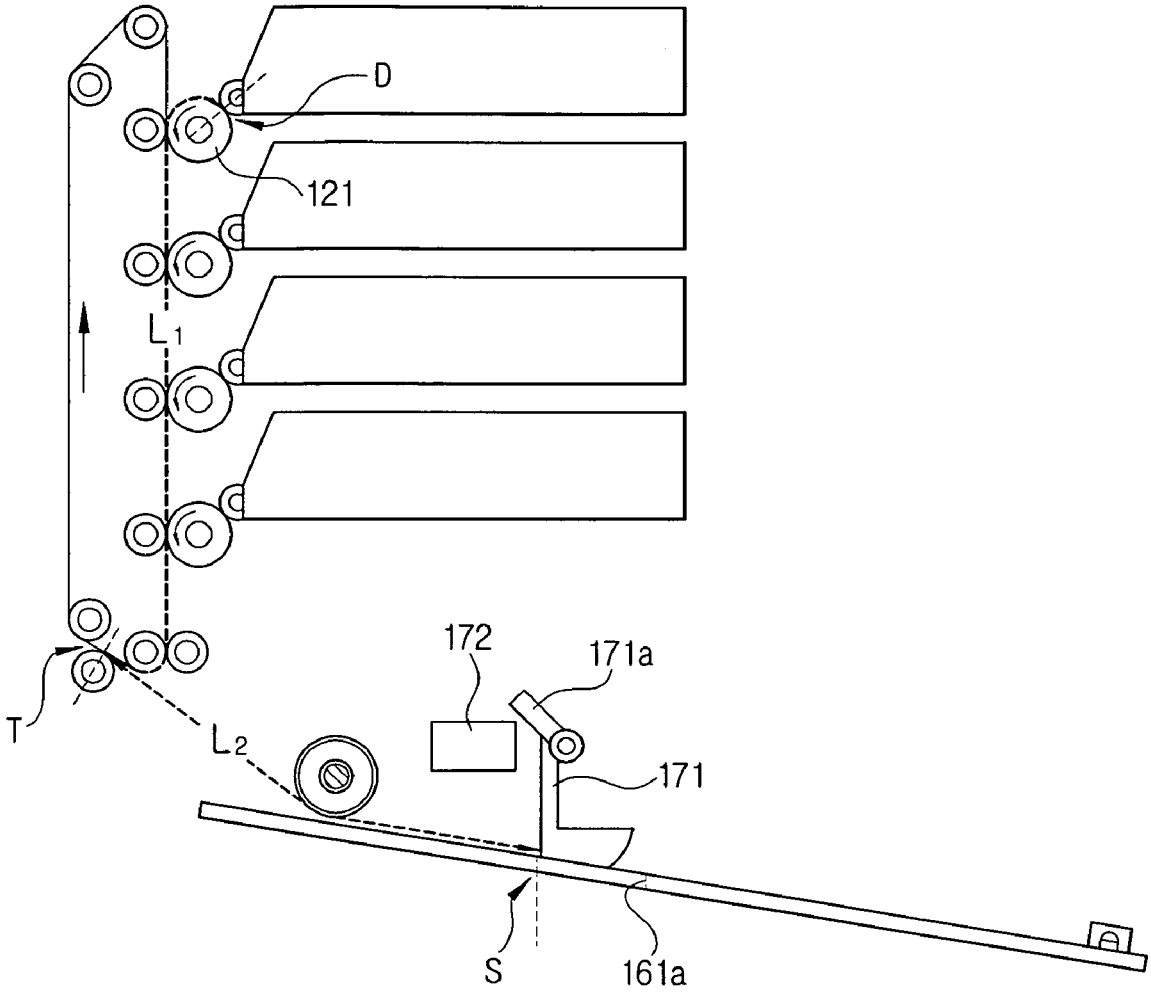
FIG. 2 (PRIOR ART)
FIG. 2 illustrates the operation of the conventional image forming apparatus.
Figure 3:
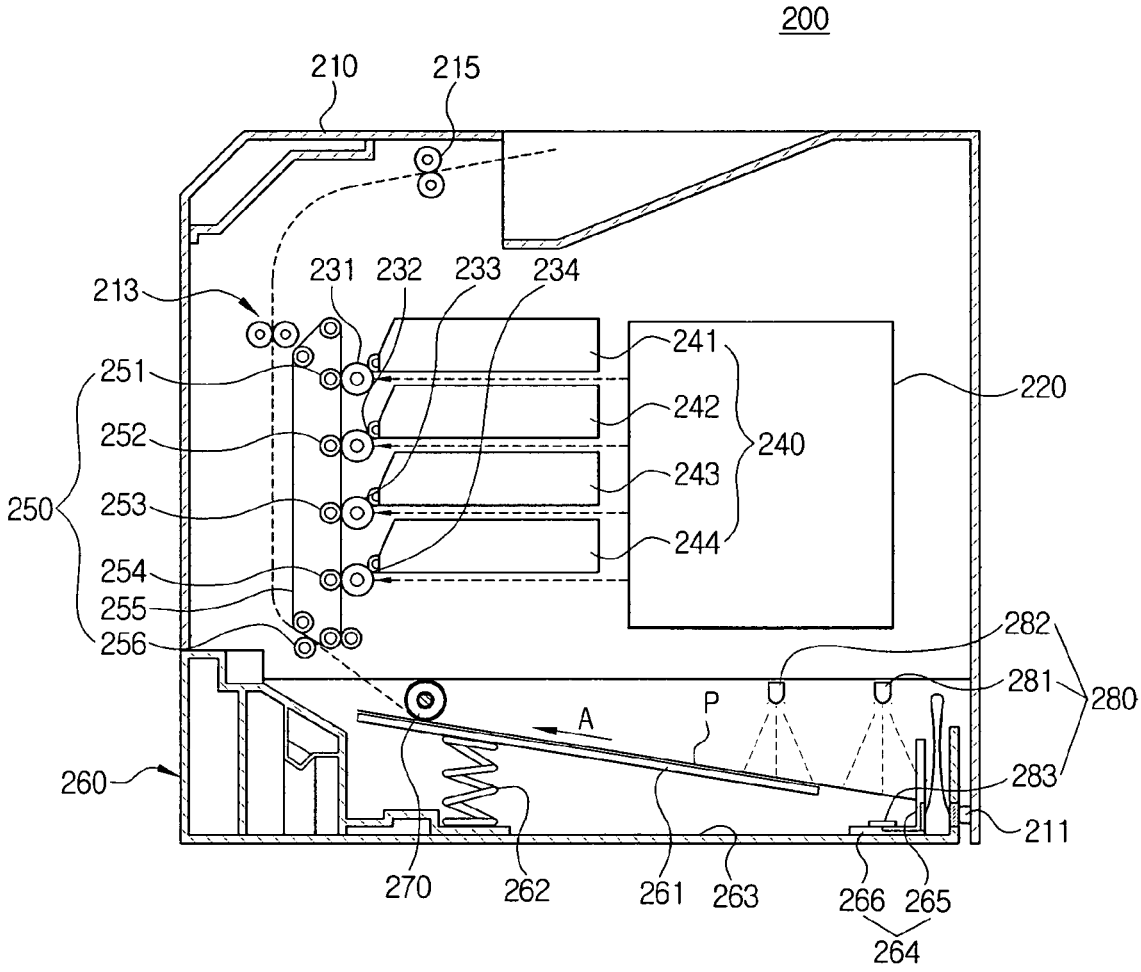
FIG. 3 illustrates the structure of an image forming apparatus according to an embodiment of the present invention.
Figure 4:
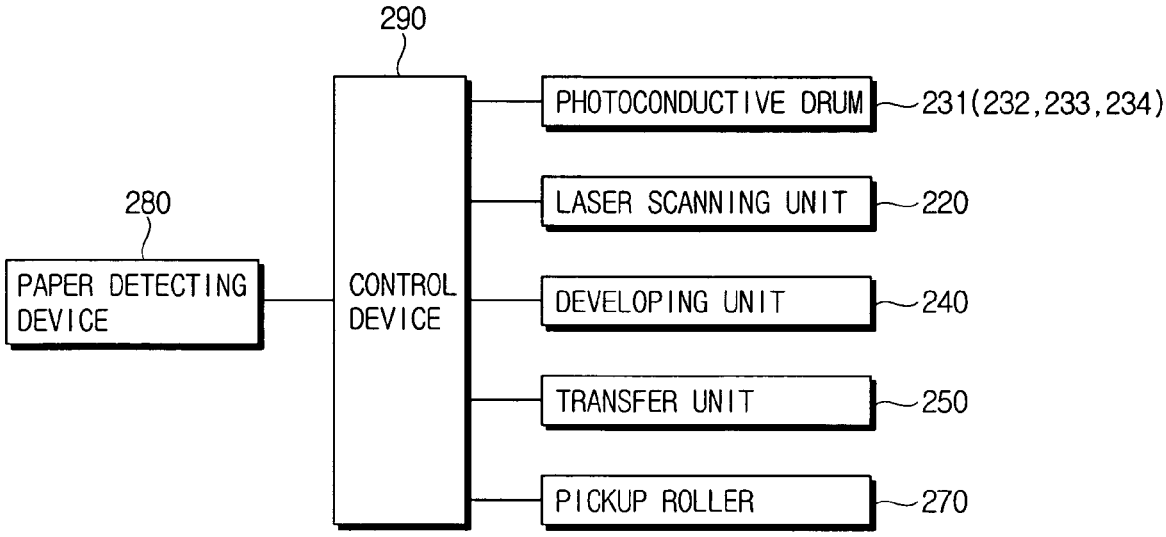
FIG. 4 is a block diagram illustrating a structure of an image forming apparatus according to an embodiment of the present invention.

As shown in FIG. 3 and FIG. 4, the image forming apparatus 200 according to an embodiment of the present invention comprises a main body 210, a laser scanning unit 220, a first, second, third and fourth photoconductive drum 231, 232, 233 and 234, a developing unit 240, a transfer unit 250, a paper feeding cassette 260, a pickup roller 270, a paper detecting device 280, and a controlling device 290.

The laser scanning unit 220 scans a laser and forms an electrostatic latent image on a photoconductive medium, such as photoconductive drums 231, 232, 233 and 234 of FIG. 3.

The developing unit 240 comprises a first, second, third and fourth developing apparatus 241, 242, 243 and 244 that correspond to the photoconductive drums 231, 232, 233 and 234. Each of the developing apparatus 241, 242, 243 and 244 stores different colors of toner, for example, yellow, magenta, cyan and black. As more clearly shown in FIG. 7, the developing unit 240 also comprises developing rollers 245, 246, 247 and 248 for attaching the toner onto the respective photoconductive drums 231, 232, 233 and 234.

The transfer unit 250 comprises a first, second, third and fourth intermediate transfer roller 251, 252, 253 and 254, a transfer belt 255, and a final transfer roller 256. The intermediate transfer rollers 251, 252, 253 and 254 are mounted to direct the transfer belt 255 toward the photoconductive drums 231, 232, 233 and 234, and transfer toner images formed on the respective photoconductive drums 231, 232, 233 and 234 to the transfer belt 255. The transfer belt 255 is supported and driven by a plurality of additional rollers, a number of which are shown for example purposes. On the transfer belt 255, a final image is formed, which is an overlap of the four colors of yellow, magenta, cyan and black. The final transfer roller 256 transfers the final image formed on the transfer belt 255 to a printing paper P.

The paper feeding cassette 260 is detachably mounted at a lower part of the main body 210 of the image forming apparatus. A paper plate 261 wherein the paper P is stacked, is provided in the paper feeding cassette 260, and the paper plate 261 is elastically supported by a spring 262. On a bottom member 263 of the paper feeding cassette 260, an end-fence 264 is movably mounted to arrange a rear edge of the paper P stacked on the paper plate 261. The end-fence 264 can be manually moved in a paper-moving direction A depending upon the paper sizes being used, and comprises a fence wall 265 and a base 266. As shown in FIG. 3, the fence wall 265 supports the rear edge of the stacked paper P, and the base 266 is mounted at a lower part of the fence wall 265 to move back and forth in the paper-moving direction A along a guide rail 263*a* (See FIG. 6) which is formed on the bottom member 263 of the paper feeding cassette 260.

The pickup roller 270 picks up the paper P stacked on the paper plate 261 sheet by sheet, and transfers the picked-up paper P to the final transfer roller 256.

The paper detecting device 280 includes a first and a second light-emitting device 281 and 282, and a light-receiving sensor 283 in order to detect the presence of the paper P on the paper plate 261. The two light-emitting devices 281 and 282 are mounted above the paper plate 261, and the light-receiving sensor 283 is mounted on the base 266 of the end-fence 264. The first and the second light-emitting devices 281 and 282 can be mounted in the paper feeding cassette 260 or in the main body 210. The light-emitting devices 281 and 282 are spaced apart from each other at a predetermined distance along a path of the end-fence 264 such that each detection beam emitted from the light-emitting devices 281 and 282 can meet the light-receiving sensor 283 as positioned on the path depending upon the paper sizes being used, as illustrated by the positions of the fence 264 in FIG. 3 and FIG. 5.

The light-receiving sensor 283 is electrically connected to a connection terminal 265*a* provided at one side of the end-fence 264. The connection terminal 265*a* is connected to an intermediate terminal 268 provided at one side of the paper feeding cassette 260 through a cable 267, and the intermediate terminal 268 is connected to a power supplying terminal 211 (See FIG. 3) provided in the main body 210 (See FIG. 3). Although a cable 267 is adopted for the connection between the intermediate terminal 268 of the paper feeding cassette 260 and the connection terminal 265*a* of the end-fence 264 in this embodiment example, the present invention is not limited to the use of such a cable and can incorporate any number of suitable electrical connection techniques. For example, the guide rail 263*a* (See FIG. 6) of the paper feeding cassette 260 can be formed having a conductive rail such that the power applied to the intermediate terminal 268 can be continuously supplied to the light-receiving sensor 283 regardless of the position or the movement of the end-fence 264.

Figure 5:
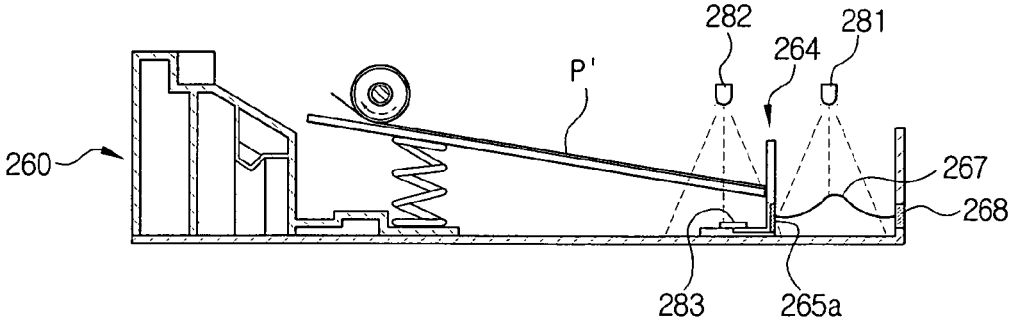
FIGS. 5 and 6 are a side view and a plan view, respectively, showing the main parts of an image forming apparatus according to an embodiment of the present invention.
Figure 6:
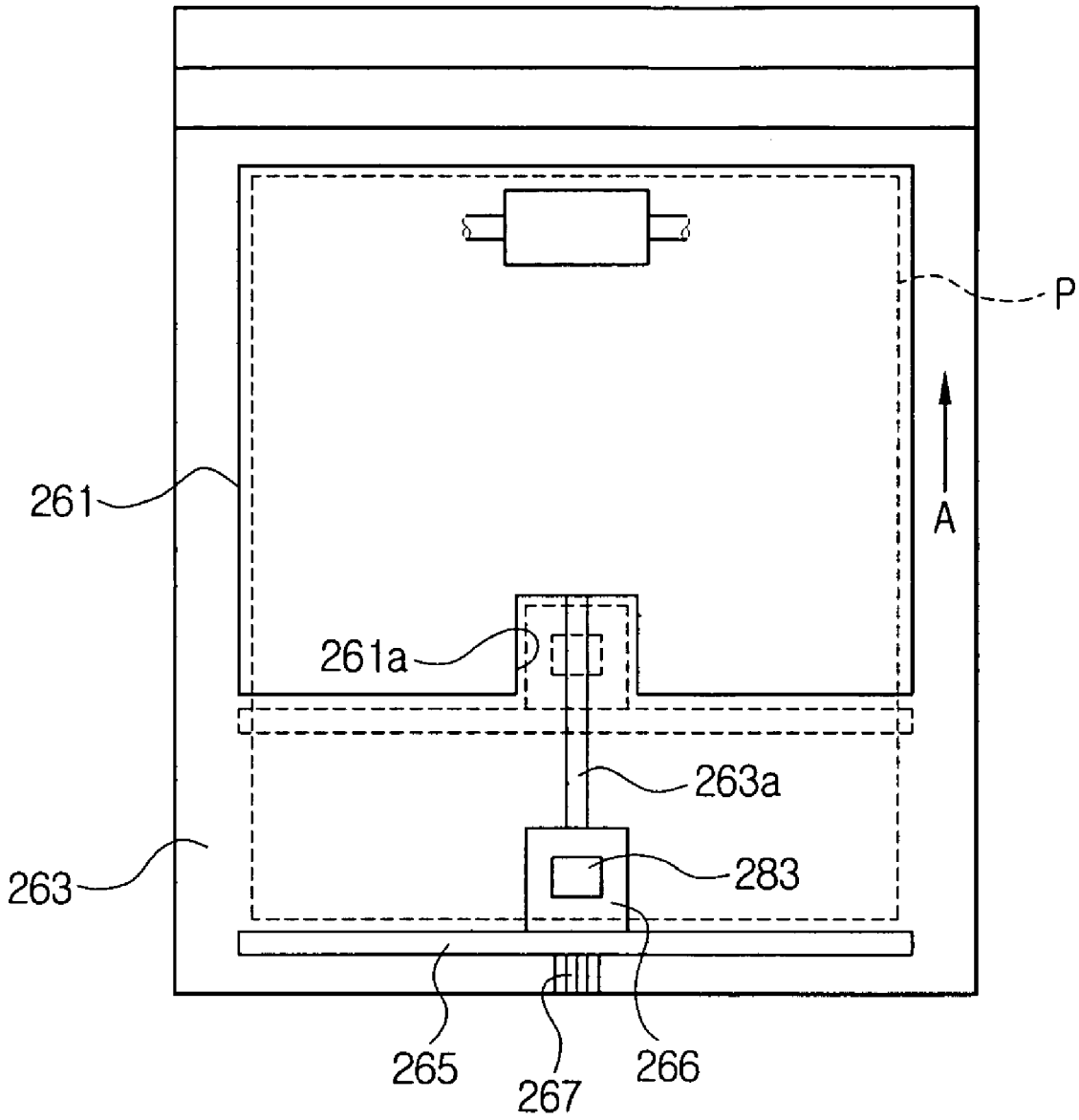

As shown in FIG. 3, if the paper P is stacked on the paper plate 261, the light-receiving sensor 283 is covered by the paper P and therefore, can not receive the detection beam from the light-emitting devices 281 and 282. However, if the paper P is exhausted, the detection beam from the light-emitting devices 281 and 282 can reach the light-receiving sensor 283 and therefore, the light-receiving sensor 283 senses the beam and detects the complete consumption of the paper P. As shown in FIG. 3, if large-size paper P is stacked on the paper plate 261, the light-receiving sensor 283 senses the detection beam from the first light-emitting device 281 to detect the complete consumption of the paper P. As shown in FIG. 5, if small-size paper P is stacked on the paper plate 261, the light-receiving sensor 283 senses the detection beam from the second light-emitting device 282 to detect the complete consumption of the paper P. This is possible even though the paper plate 261 is shown extending between the second light-emitting device 282 and the bottom member 263 of the paper feeding cassette 260. As shown in FIG. 6, the detection beam emitted from the second light-emitting device 282 reaches the light-receiving sensor 283 through a cut-out section 261*a* formed through the paper plate 261.

As shown in FIG. 4, the control device 290 receives information on the presence of the paper P in the paper feeding cassette 260 from the paper detecting device 280, and controls overall printing work, paper-feeding and paper-discharging work of the image forming apparatus 200, which include the operations of the respective photoconductive drums 231, 232, 233 and 234, the laser scanning unit 220, the developing unit 240, the transfer unit 250 and the pickup roller 270.

Hereinbelow, the operation of the image forming apparatus according to an embodiment of the present invention will be described in greater detail with reference to the accompanying drawings.

With the application of a printing command to the image forming apparatus 200 as shown in FIG. 3, the laser scanning unit 220 sequentially scans the first, second, third and fourth photoconductive drums 231, 232, 233 and 234, thereby forming an electrostatic latent image on the respective photoconductive drums 231, 232, 233 and 234. On the photoconductive drums 231, 232, 233 and 234 having the electrostatic latent image, color toners such as yellow, magenta, cyan and black, supplied from the first, second, third and fourth developing devices 241, 242, 243 and 244 are attached to form toner images. The toner images of the respective colors are transferred to the transfer belt 255 by the first, second, third and fourth intermediate transfer rollers 251, 252, 253 and 254 in order. Thus, a final image is obtained on the transfer belt 255.

The paper P stacked on the paper plate 261 in the paper feeding cassette 260 is picked up sheet by sheet by the pickup roller 270, and is provided to the final transfer roller 256. The rear edge of the paper P is aligned into proper arrangement by contacting the fence wall 265 of the end-fence 264, and once positioned, covers the light-receiving sensor 283 mounted on the base 266 of the end-fence 264. Therefore, the detection beam from the first and second light-emitting devices 281 and 282 cannot reach the light-receiving sensor 283.

When the picked-up paper P arrives between the transfer belt 255 and the final transfer roller 256, the final image formed on the transfer belt 255 is transferred to the paper P by the final transfer roller 256. The paper P, including the final image, then passes through a fixing unit 213, and is discharged out of the main body 210 by a paper-discharging roller 215.

Figure 7:
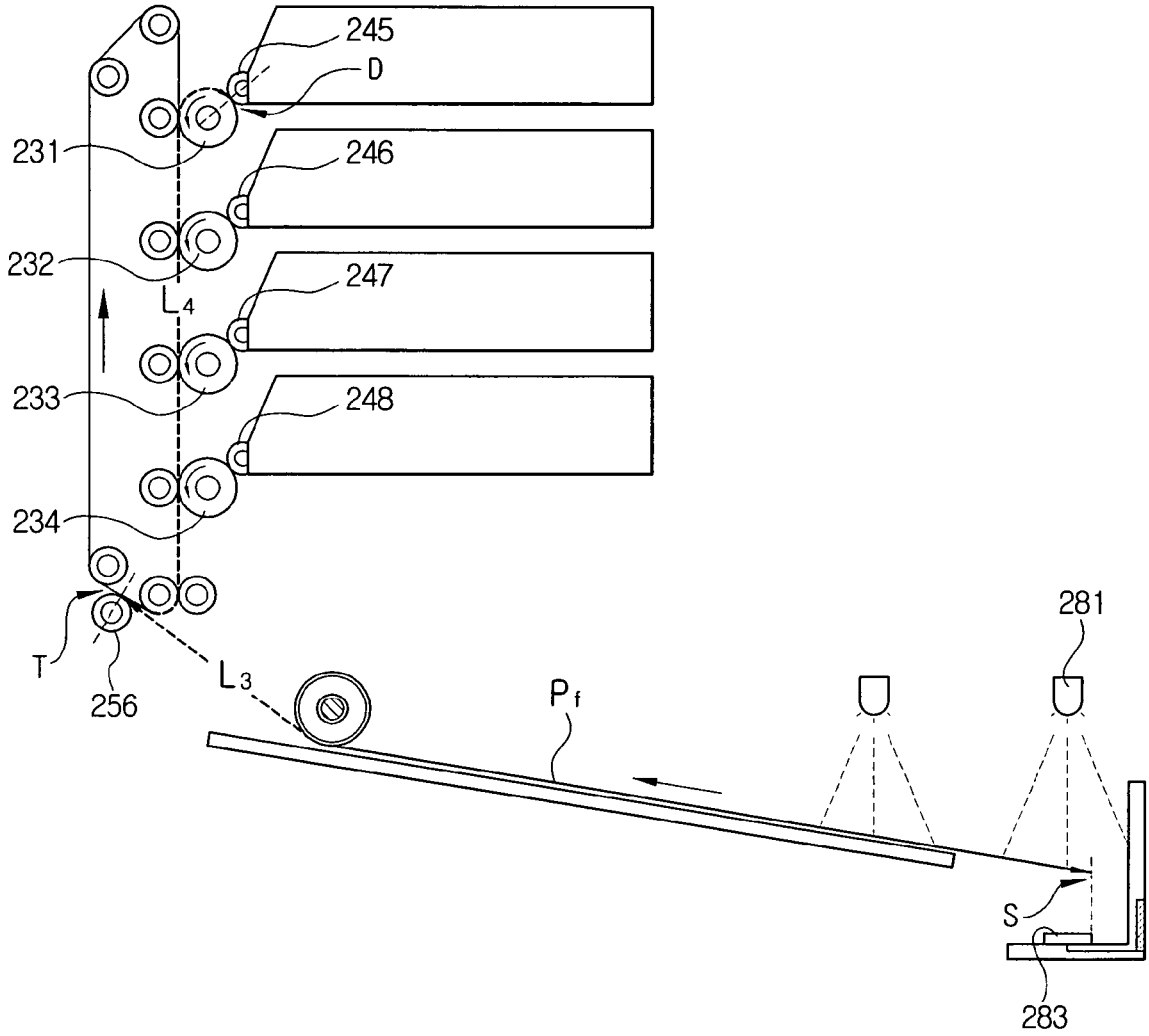
FIG. 7 is a view illustrating the operation of a paper detecting device of a paper feeding cassette and an image forming apparatus according to an embodiment of the present invention.

During the printing operation, the developing operation continues such that the toner images are sequentially formed by the photoconductive drums 231, 232, 233 and 234. Pickup of the paper P in the paper feeding cassette 260 also continues. As shown in FIG. 7, when a last sheet of paper $P_f$ is picked up from the paper plate 261 such that the edge of the paper P is moved from between the light-receiving sensor 283 and the light-emitting device 281, the detection beam from the first light-emitting device 281 reaches the light-receiving sensor 283. The control device 290 (See FIG. 4) receives information on the complete consumption of the paper P from the paper detecting device 280 (See FIG. 4), and controls the operations of the respective parts to suspend the printing work.

In addition to the distances $L_1$ and $L_2$ defined above, a third distance $L_3$ is provided by the embodiments of the present invention and is defined as the distance from a sensing position S where the light-receiving sensor 283 senses the detection beam substantially concurrent with the pickup and transfer of the last paper sheet $P_f$, to a transfer position T where the final image is transferred by the final transfer roller 256. A fourth distance $L_4$ is defined as the distance from a first developing position D where the toner is attached on the first photoconductive drum 231 by the first developing roller 245, to the transfer position T, and is substantially equal to the distance $L_1$.

As noted above, in the conventional image forming apparatus 100 a first distance $L_1$ is substantially longer than a second distance $L_2$ (i.e., $(L_1=L_4)>L_2$). Therefore the conventional paper detecting device detects the exhaustion of the paper P in the paper feeding cassette after a first developing is performed on the first photoconductive drum. Since the third distance $L_3$ is longer than the fourth distance $L_4$ in the embodiments of the present invention ($(L_1=L_4)<L_3$), the printing work can be stopped before forming the electrostatic latent image on the photoconductive drums 231, 232, 233 and 234, and performing the developing operation.

Figure 8:
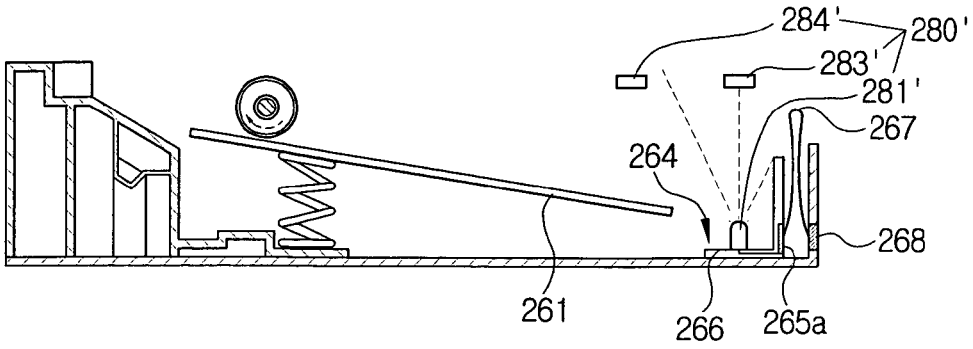
FIG. 8 is a side view of a paper detecting device of a paper feeding cassette according to another embodiment of the present invention.
Figure 9:
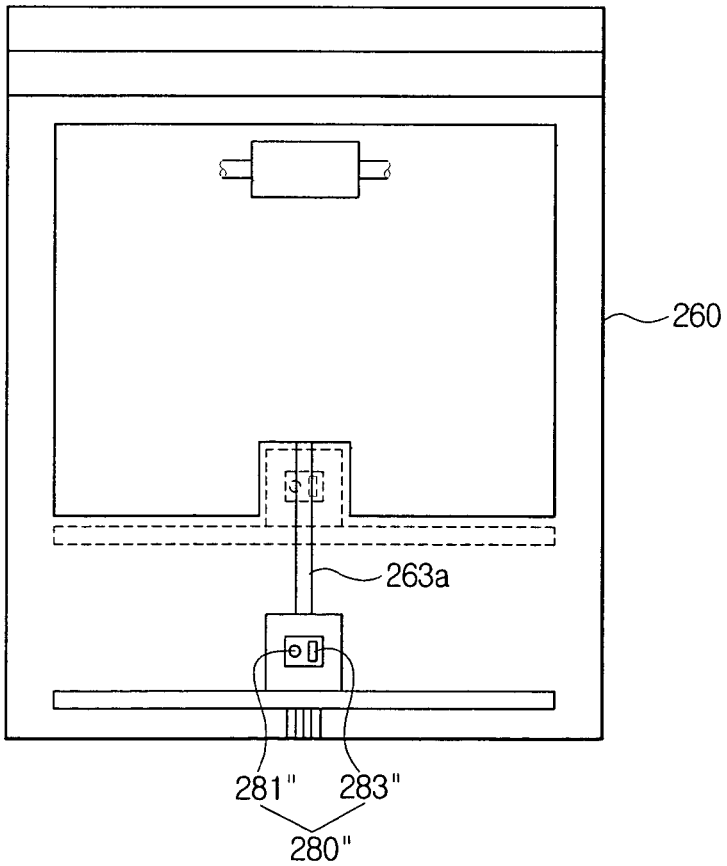
FIGS. 9 and 10 are a plan view and a side view, respectively, showing a paper detecting device of a paper feeding cassette according to still another embodiment of the present invention.
Figure 10:
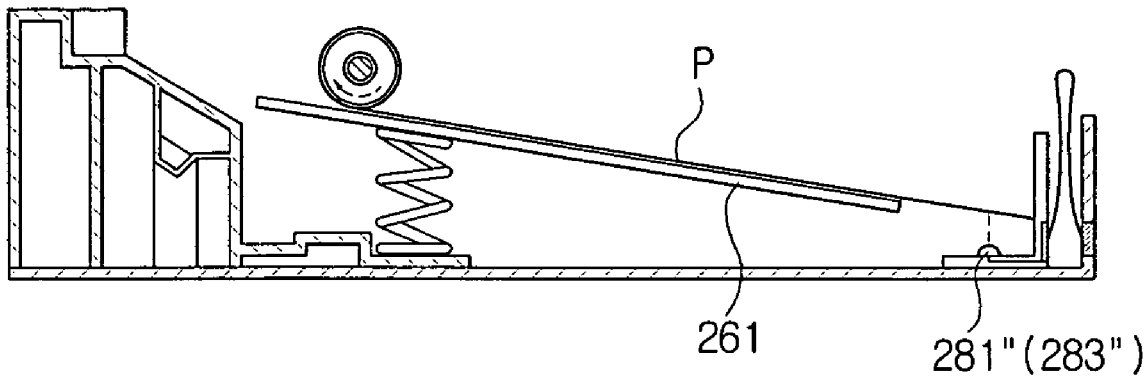

FIGS. 8 through 10 illustrate a portion of the structure of a paper detecting device and an image forming apparatus according to another embodiment of the present invention. In referring to elements which have the same structure and operation as in the foregoing embodiment, the elements will be cited by the same reference numerals.

In FIG. 8, a paper detecting device 280' of the paper feeding cassette according to another embodiment of the present invention comprises a single light-emitting device 281', and first and second light-receiving sensors 283' and 284'. The light-emitting device 281' is provided on the base 266 of the end-fence 264. Electricity is applied to the light-emitting device 281' in the same manner as in applying the power to the light-receiving sensor 283 formed on the base 266 in the image forming apparatus 200 (See FIG. 3) of the foregoing embodiment. More specifically, the light-emitting device 281' is electrically connected with the connection terminal 265*a* of the end-fence 264, and the connection terminal 265*a* is connected to the intermediate terminal 268 through the cable 267. In addition, the first and the second light-receiving sensors 283' and 284' are mounted above the paper plate 261 at a predetermined distance from each other along the path of the end-fence 264.

In the paper detecting device 280' of the above structure, if the paper plate 261 has the paper P stacked thereon, the detection beam emitted from the light-emitting device 281' can not reach the first or second light-receiving sensor 283' or 284'. However, when the stacked paper P is exhausted, the first or the second light-receiving sensor 283' or 284' senses the detection beam emitted from the light-emitting device 281', thereby detecting the complete consumption of the paper.

FIGS. 9 and 10 show the paper detecting device 280" according to still another embodiment of the present invention, wherein the light-emitting device 281" and the light-receiving sensor 283" are mounted in a single body and comprises a reflection type sensor. The light-emitting device 281" and the light-receiving sensor 283" are both mounted on the base 266 of the end-fence 264 which moves along the guide rail 263*a* of the paper feeding cassette 260. As shown in FIG. 10, when the paper P is stacked on the paper plate 261, the paper P covers the tops of the light-emitting device 281" and the light-receiving sensor 283". The detection beam from the light-emitting device 281" reaches the light-receiving sensor 283" by being reflected by the paper P surface. If the paper P is exhausted and therefore no longer within the range of the light-emitting device 281" and the light-receiving sensor 283", the detection beam can not be reflected to the light-receiving sensor 283". Accordingly, the complete consumption of the paper P is detected.

Although a tandem-type color printer comprising the plurality of photoconductive drums 231, 232, 233 and 234, and the transfer belt 255 as a transfer medium has been described and illustrated in the embodiment examples, the present invention is not limited thereto. The embodiments of the present invention can be applied to any number of other diverse image forming apparatus.

As can be appreciated from the above description, before the developing operation is performed for a new image, the complete consumption of the paper P supply can be detected. Therefore, the toner and operation processes of the parts of the image forming apparatus can be economized.

While the invention has been shown and described with reference to certain embodiments thereof, it will be understood by those skilled in the art that various changes in form and details may be made therein without departing from the spirit and scope of the invention as defined by the appended claims.

What is claimed is:

1. A paper detecting device for determining paper presence on a paper plate in a paper feeding cassette detachably mounted in a main body of an image forming apparatus, the paper detecting device mounted on an end-fence to move in the paper feeding cassette, comprising:

at least one of a light-emitting device which emits a detection beam;

at least one of a light-receiving sensor which senses the detection beam; and wherein at least one of the light-emitting device and the light-receiving sensor is covered by a planar surface of the paper on the paper plate and at least one of the light-emitting device and the light-receiving sensor is mounted on a base of the end fence.

2. The paper detecting device of claim 1, wherein the light-emitting device is mounted above the paper plate, and the light-receiving sensor is mounted on a base of the end-fence.

3. The paper detecting device of claim 2, wherein a plurality of the light-emitting devices are provided and being distanced apart from each other along a path of the end-fence.

4. The paper detecting device of claim 1, wherein the light-receiving sensor is mounted above the paper plate, and the light-emitting device is mounted on a base of the end-fence.

5. The paper detecting device of claim 4, wherein a plurality of the light-receiving sensors are provided and being distanced apart from each other along a path of the end-fence.

6. A paper detecting device for determining paper presence on a paper plate in a paper feeding cassette detachably mounted in a main body of an image forming apparatus, the paper detecting device mounted on an end-fence to move in the paper feeding cassette, comprising:

at least one of a light-emitting device which emits a detection beam; and at least one of a light-receiving sensor which senses the detection beam, wherein at least one of the light-emitting device and the light-receiving sensor is covered by the paper on the paper plate, both the light-emitting device and the light-receiving sensor are mounted on a base of the end-fence and the light-receiving sensor senses the detection beam which is emitted from the light-emitting device and reflected by the paper on the paper plate.

7. An image forming apparatus comprising:

a main body;

a laser scanning unit for emitting a laser beam;

a photoconductive medium for forming an electrostatic latent image thereon by the laser beam from the laser scanning unit;

a developing unit for forming ,a toner image by attaching a toner onto the electrostatic latent image formed on the photoconductive medium;

a transfer unit for transferring the toner image to a paper;

a paper feeding cassette having a paper plate for stacking papers;

an end-fence having a fence wall for arranging an end of the stacked paper in alignment therewith, and a base for supporting and enabling the fence wall to move in the paper feeding cassette;

a pickup roller for picking up and transferring the stacked paper toward the transfer unit;

a paper detecting device for detecting the paper stacked on the paper plate and having a light-emitting device and a light-receiving sensor; and a control device for controlling the laser scanning unit, the photoconductive medium, the developing unit, the transfer unit, and the pickup roller, wherein at least one of the light-emitting device and the light-receiving sensor is mounted on the base of the end-fence to be covered by the paper stacked on the paper plate.

8. The image forming apparatus of claim 7, wherein the light-emitting device is mounted above the paper plate, and the light-receiving sensor is mounted on the base of the end-fence.

9. The image forming apparatus of claim 8, wherein a plurality of the light-emitting devices are provided and being distanced apart from each other along a path of the end-fence.

10. The image forming apparatus of claim 8, further comprising:

a power supplying terminal mounted in the main body;

an intermediate terminal mounted in the paper feeding cassette electrically connected with the power supplying terminal; and a connection terminal mounted in the end-fence to electrically connect the light-receiving sensor and the intermediate terminal.

11. The image forming apparatus of claim 10, wherein the intermediate terminal and the connection terminal are connected by a cable.

12. The image forming apparatus of claim 7, wherein the light-receiving sensor is mounted above the paper plate, and the light-emitting device is mounted on the base of the end-fence.

13. The image forming apparatus of claim 12, wherein a plurality of the light-receiving sensors are provided and being distanced apart from each other along a path of the end-fence.

14. The image forming apparatus of claim 12, further comprising:

a power supplying terminal mounted in the main body;

an intermediate terminal mounted in the paper feeding cassette electrically connected with the power supplying terminal; and a connection terminal mounted in the end-fence to electrically connect the light-receiving sensor and the intermediate terminal.

15. The image forming apparatus of claim 14, wherein the intermediate terminal and the connection terminal are connected by a cable.

16. The image forming apparatus of claim 7, wherein:

both the light-emitting device and the light-receiving sensor are mounted on the base of the end-fence; and the light-receiving sensor senses the detection beam which is emitted from the light-emitting device and reflected by the paper on the paper plate.

17. A method for determining paper presence on a paper plate in a paper feeding cassette detachably mounted in a main body of an image forming apparatus, the paper detecting device mounted on an end-fence to move in the paper feeding cassette, comprising the steps of:

emitting a detection beam toward a planar surface of the paper;

sensing the detection beam; and positioning a paper supply against the end-fence to effect a change in the detection beam, such that an absence of paper is detected and wherein at least one of a light-emitting device for emitting the detection beam and a light-receiving sensor for sensing the detection beam is mounted on a base of the end fence.

18. The paper detecting method of claim 17, wherein the light-emitting device for emitting the detection beam is mounted above the paper, and the light-receiving sensor for sensing -the detection beam is mounted on a base of the end-fence.

19. The paper detecting method of claim 17, wherein the light-receiving sensor for sensing the detection beam is mounted above the paper, and the light-emitting device for emitting the detection beam is mounted on a base of the end-fence.

20. A method for determining paper presence on a paper plate in a paper feeding cassette detachably mounted in a main body of an image forming apparatus, the paper detecting device mounted on an end-fence to move in the paper feeding cassette, comprising the steps of:

emitting a detection beam;

sensing the detection beam; and positioning a paper supply against the end-fence to effect a change in the detection beam, such that an absence of paper is detected, wherein, both a light-emitting device and a light-receiving sensor are mounted on a base of the end-fence and the light-receiving sensor senses the detection beam which is emitted from the light-emitting device and reflected by the paper on the paper plate.

* * * * *